US009597573B2

(12) United States Patent
Chung

(10) Patent No.: US 9,597,573 B2
(45) Date of Patent: Mar. 21, 2017

(54) HORSE RIDING EXERCISE MACHINE

(71) Applicant: Pildong Chung, Gyeonggi-do (KR)

(72) Inventor: Pildong Chung, Gyeonggi-do (KR)

( * ) Notice: Subject to any disclaimer, the term of this patent is extended or adjusted under 35 U.S.C. 154(b) by 0 days.

(21) Appl. No.: 14/755,645

(22) Filed: Jun. 30, 2015

(65) Prior Publication Data

US 2016/0001155 A1 Jan. 7, 2016

(30) Foreign Application Priority Data

Jul. 4, 2014 (KR) ..... 10-2014-0083858

(51) Int. Cl.

| | |
|---|---|
| ***A63G 13/06*** | (2006.01) |
| ***A63G 17/00*** | (2006.01) |
| ***A63B 26/00*** | (2006.01) |
| ***A63B 71/00*** | (2006.01) |
| ***A63B 69/04*** | (2006.01) |
| ***A63B 24/00*** | (2006.01) |

(52) U.S. Cl.

CPC ..... *A63B 69/04* (2013.01); *A63B 24/0087* (2013.01); *A63B 2208/0233* (2013.01)

(58) Field of Classification Search

CPC ..... A63B 69/04; A63B 22/14; A63B 22/16; A63B 22/18; A63B 26/003; A63B 24/0087; A63B 23/02; A63B 23/0205; A63B 23/0211; A63B 23/0222; A63B 21/00; A63B 21/0004; A63B 21/00178; A63B 21/06; A63B 21/068; A63B 21/22; A63B 21/225; A63B 21/40; A63B 21/0087; A63B 21/0089; A63G 19/00; A63G 19/02; A63G 19/04; A63G 19/06; A63G 19/08; A63G 19/10; A63G 19/12; A63G 19/14; A63G 19/20

USPC ..... 472/95–97, 100–101

See application file for complete search history.

(56) References Cited

U.S. PATENT DOCUMENTS

| | | | | |
|---|---|---|---|---|
| 2,120,102 | A * | 6/1938 | Kurelic | A63G 19/06 280/1.181 |
| 2,915,311 | A * | 12/1959 | Delano | A63G 19/20 472/97 |
| 6,808,458 | B1 * | 10/2004 | Jung | A63B 69/04 434/247 |
| 7,749,088 | B2 * | 7/2010 | Greenwood | A63B 69/04 434/247 |
| 2007/0207900 | A1 * | 9/2007 | Huang | A63B 26/003 482/51 |
| 2008/0171606 | A1 * | 7/2008 | Chuang | A63B 69/04 472/97 |
| 2009/0005186 | A1 * | 1/2009 | Tseng | A63K 3/00 472/97 |

(Continued)

*Primary Examiner* — Sundhara Ganesan
*Assistant Examiner* — Nyca T Nguyen
(74) *Attorney, Agent, or Firm* — Rabin & Berdo, P.C.

(57) ABSTRACT

A horse riding exercise machine includes: a saddle support; an operation frame; a pair of operation rods; an elevation rod; a forward-backward rod; a vertical bar; a movable bar; a flywheel; a rotation frame; a main spring; a gear; and a handle. The horse riding exercise machine can be driven without power by using energy stored in the flywheel so noise from the motor and a drive apparatus indoor can be suppressed and energy consumption can be prevented, and, specifically, the horse riding exercise machine can be adjusted suitable for the weight of the user by using the handle and the foot support can be used according to the height of the user.

7 Claims, 16 Drawing Sheets

(56) References Cited

U.S. PATENT DOCUMENTS

| | | | | |
|---|---|---|---|---|
| 2010/0125024 | A1* | 5/2010 | Nakano | A63B 22/16<br>482/4 |
| 2010/0234197 | A1* | 9/2010 | Huang | A61H 1/005<br>482/142 |
| 2013/0045812 | A1* | 2/2013 | Garner | A63G 19/20<br>472/97 |

* cited by examiner

HORSE RIDING EXERCISE MACHINE

BACKGROUND OF THE INVENTION

1. Field of the Invention

The present invention relates to a horse riding exercise machine, and more particularly, to a horse riding exercise machine which can be operated without power and can be adjusted suitable for weight and height of a user.

2. Description of the Related Art

Recently, the number of obese people, from children to adults and regardless of sex, is rapidly rising due to rapid westernization of dietary life and lack of exercise. The rapid rise in the number of obese people is having an enormously bad influence nationally, socially and individually. Obesity has become a social epidemic, and exercise has been the easiest method as the solution of obesity for obese people.

Specifically, an obese person makes efforts to get rid of obesity through methods of walking without using a separate exercise machine and methods of using an exercise machine such as a treadmill to break down the fat in the body, which brings about obesity.

However, these typical exercise methods are monotonous and tedious regardless of whether using the exercise machine or not, so obese people easily give up and so these methods are not a big help for getting rid of obesity.

In addition, horse riding is an exercise having an unusual characteristic in which the rider is required to be in unity with a living horse, is a sport which trains the body and enlivens one's spirit by fostering chivalry, and is an exercise of the whole body which helps to properly develop the body and develop boldness and sound thinking abilities.

In addition, the horse riding is an exercise of the whole body, which can be enjoyed by men and women of all ages, and the horse riding is an exercise performed by straightening one's back such that one's posture is corrected. The horse riding can strengthen intestinal function when seating on a horse, which is moving up and down, is helpful for alleviating constipation for women and students, is effective in prostatic diseases for men, improves lung capacity and is helpful for strengthening the lower body such as calves or thighs.

Therefore, when horse riding, the upper body is straightly corrected, the waist becomes flexible, mental concentration and body rhythm are built, lung capacity is improved, the hip is strengthen, one's courage is developed, and the sense of balance and flexibility of each part of the body are developed to help properly develop a healthy body.

The fact that outstanding effects of the exercise of the whole body can be achieved through horse riding is widely known, however, majority of people cannot actually enjoy horse riding because of economic situations, locations and time.

SUMMARY OF THE INVENTION

Meanwhile, due to the reasons described above, various horse riding machines have been proposed so that horse riding may be enjoyed in narrow spaces such as an indoor, however, typical horse riding machines are driven by motors so noise occurs indoor and energy is consumed.

In addition, the horse riding machines according to typical technologies may not be adapted according to heavy adults or light teenagers, and specifically, may not be adapted according to height.

Therefore, the present invention is provided to solve the described problems, and an object of the present invention is to provide a horse riding exercise machine which can suppress noise occurring indoor, fundamentally prevents energy consumption, and appropriately adapt according to weight and height of the user.

To achieve the object of the present invention, according to an aspect of the present invention, a horse riding exercise machine includes: a body frame having a box shape; a saddle support spaced apart from a central upper part of the body frame in an upward direction by a predetermined distance to support a saddle; a pair of upper support brackets mounted on atop surface of the body frame while facing each other; a shaft coupled by the upper support bracket; an operation frame having one end rotatably coupled to the shaft; a pair of operation rods having ends parts rotatably coupled to an end part of the operation frame and opposite end parts rotatably installed to both side surface parts of a rear part of the saddle support; a lower support bracket installed at a lower part of the body frame; a coupling bar rotatably coupled to the lower support bracket; a coil spring having one end coupled to the coupling bar; a T bar formed in a "T" shape and having one end coupled to the lower support bracket; an elevation rod having one end coupled to the T bar and an opposite end coupled to the saddle support; a forward-backward rod rotatably installed on the saddle support and having one end installed to a lower part of a handle; a link rod having one end rotatably installed at a lower part of the handle and an opposite end rotatably installed at the saddle support; a first bar coupled to the forward-backward rod to interwork with the forward-backward rod and having one end rotatably installed at a front part of the saddle support; a second bar having one end rotatably installed at a rear part of the saddle support; a first rod having one end rotatably coupled to a lower end part of the first bar; a second rod rotatably coupled to the first rod; a third rod rotatably coupled to the second rod; a vertical bar having an upper end part rotatably coupled to a part at which the second rod and the third rod are coupled; a movable bar rotatably coupled at a rear end of the operation frame; a second flywheel coupled to a lower end part of the movable bar by a link to rotate through an elevation of the movable bar; a first flywheel interworking with the second flywheel by a belt; a lower bar rotatably installed at a lower end part of the vertical bar; a rotation frame having one end rotatably installed at the lower support bracket and an opposite end in a form of a free end; a main spring having one end fixed to the operation frame and an opposite end seated on a top surface of the rotation frame; a gear box installed in an inner space of the body frame and provided therein with a worm and a worm gear; a handle installed outside the body frame to rotate the worm of the gear box; and a rotation rod having one end coupled to the worm gear inside the gear box and an opposite end installed to the rotation frame to rotate by an operation of the handle.

According to the present invention, the horse riding exercise machine further includes an indication bar having one end fixed to the rotation frame and an opposite end protruding out of the body frame such that the opposite end protruding out of the body frame elevates according to an elevation of the rotation frame.

In addition, the horse riding exercise machine further includes a foot support at both side surfaces of the saddle.

Further, the foot support includes an inclined frame inclined downward; and a plurality of support bars spaced apart from the inclined frame by a predetermined distance.

According to the present invention, at least one of the support bars is foldable by a hinge.

In addition, the coupling bar interworks with the T bar.

According to the embodiment of the present invention, the horse riding exercise machine is driven without a motor and without power by using energy stored in the flywheel so noise from the motor or a drive apparatus indoor can be suppressed and energy consumption can be prevented, and, specifically, the horse riding exercise machine can be adjusted to fit the weight of the user by using the handle and the foot support can be used according to the height of the user.

DETAILED DESCRIPTION OF THE INVENTION

Hereinafter, exemplary embodiments of the present invention will be described with reference to accompanying drawings, and same reference numbers are used for same parts in every drawing.

Figure 1:
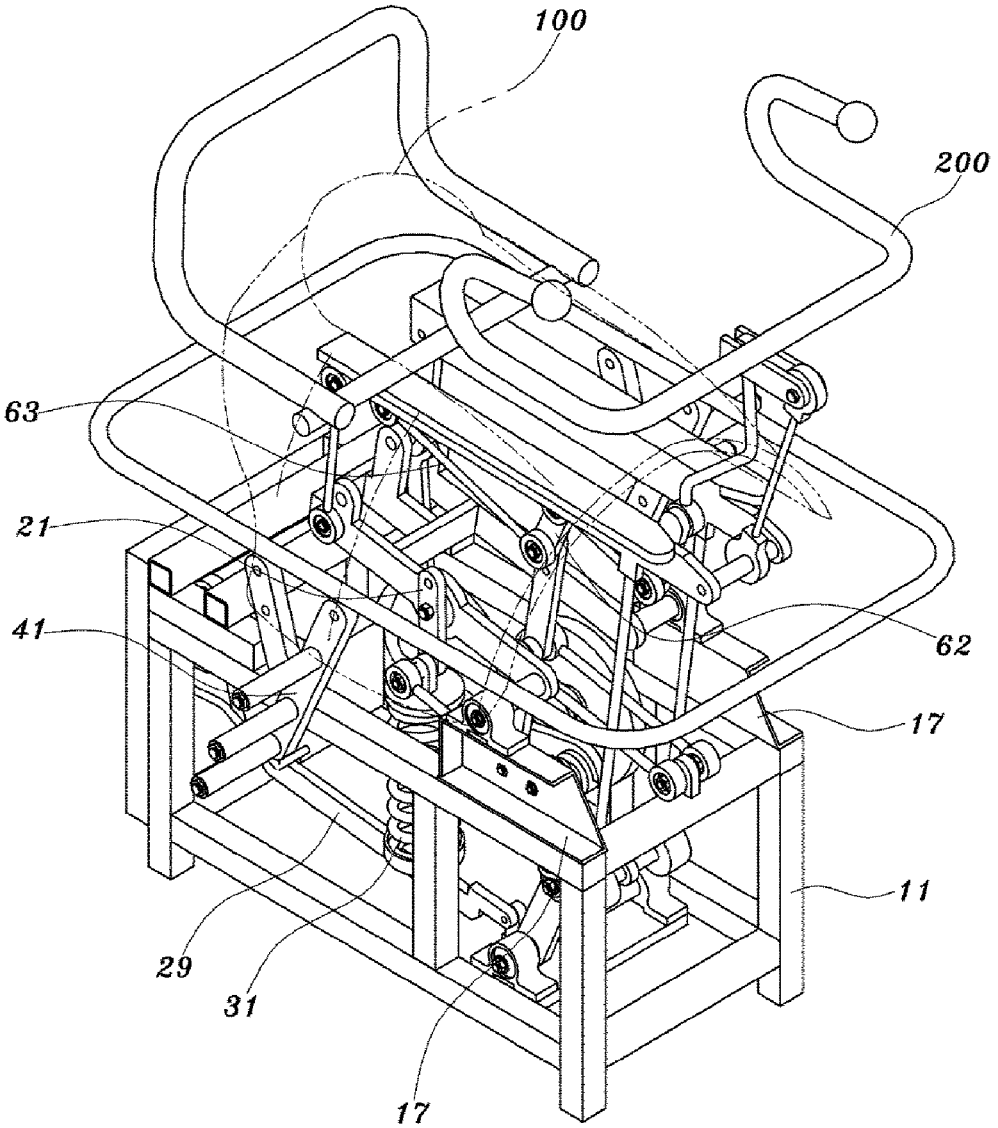
FIG. 1 is a perspective view showing main parts of a horse riding exercise machine according to an embodiment of the present invention.
Figure 2:
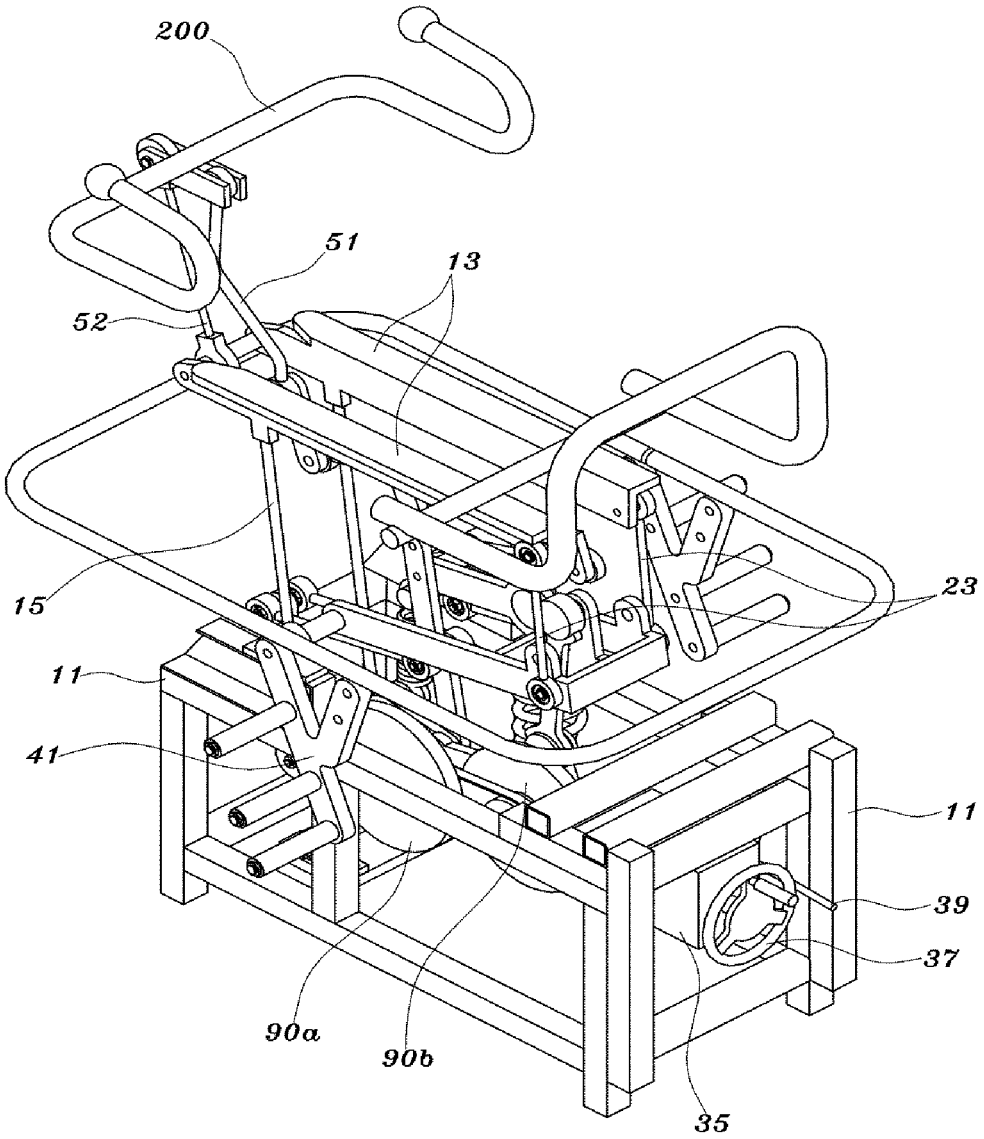
FIG. 2 is a rear perspective view showing the main parts of the horse riding exercise machine shown in FIG. 1.

FIG. 1 is a perspective view showing essential parts of a horse riding exercise machine according to an embodiment of the present invention, and FIG. 2 is a rear perspective view showing main parts of the horse riding exercise machine.

As shown in the drawing, the horse riding exercise machine according to the present invention designated as reference number 10 includes, a body frame 11 having a box shape, and a saddle support 13 spaced apart from a central upper part of the body frame 11 in an upward direction by a predetermined distance to support a saddle 100.

Figure 3:
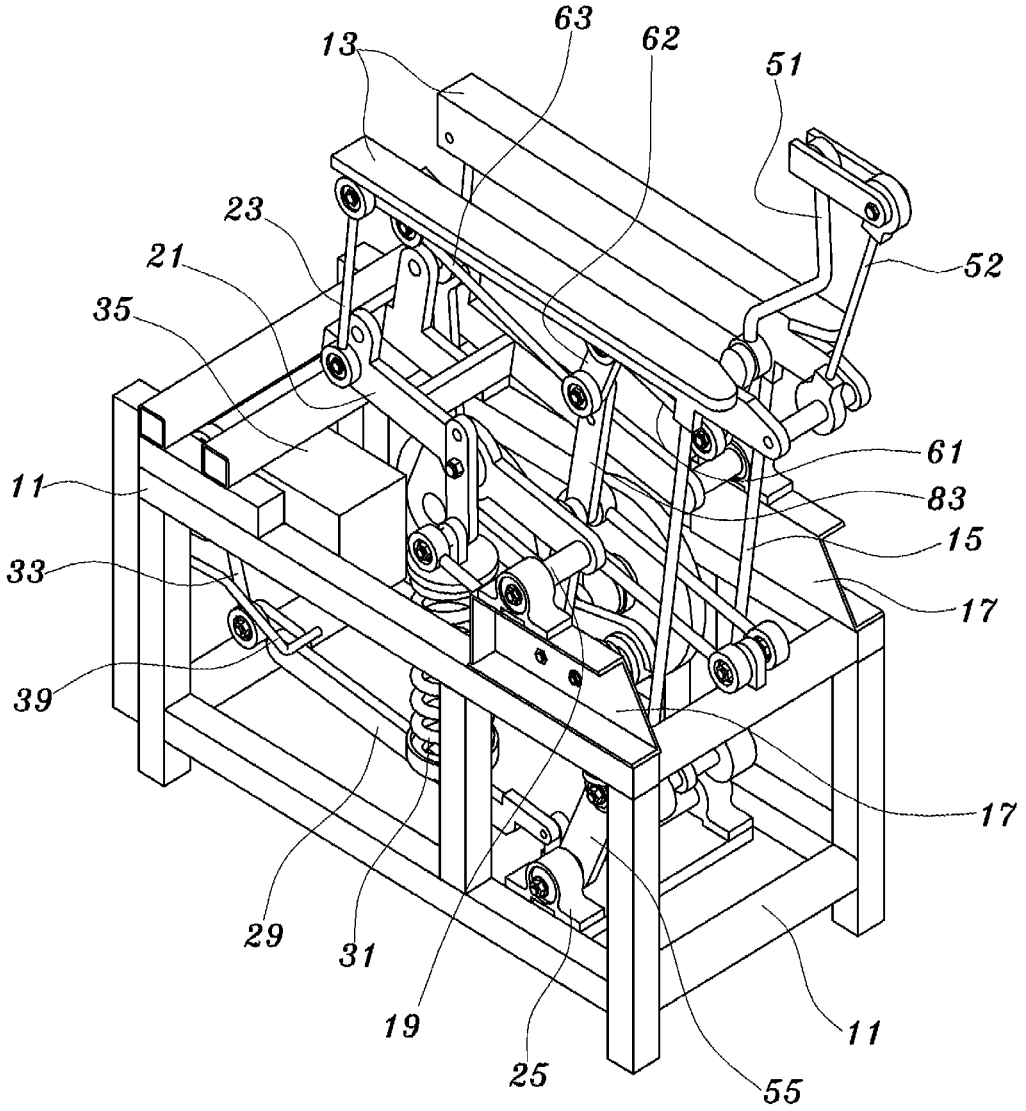
FIG. 3 is a perspective view showing the main parts.

As shown in FIG. 3, a pair of upper support brackets 17 are mounted on a top surface of the body frame 11, and shafts 19 are installed at the pair of upper support brackets 17.

Figure 6:
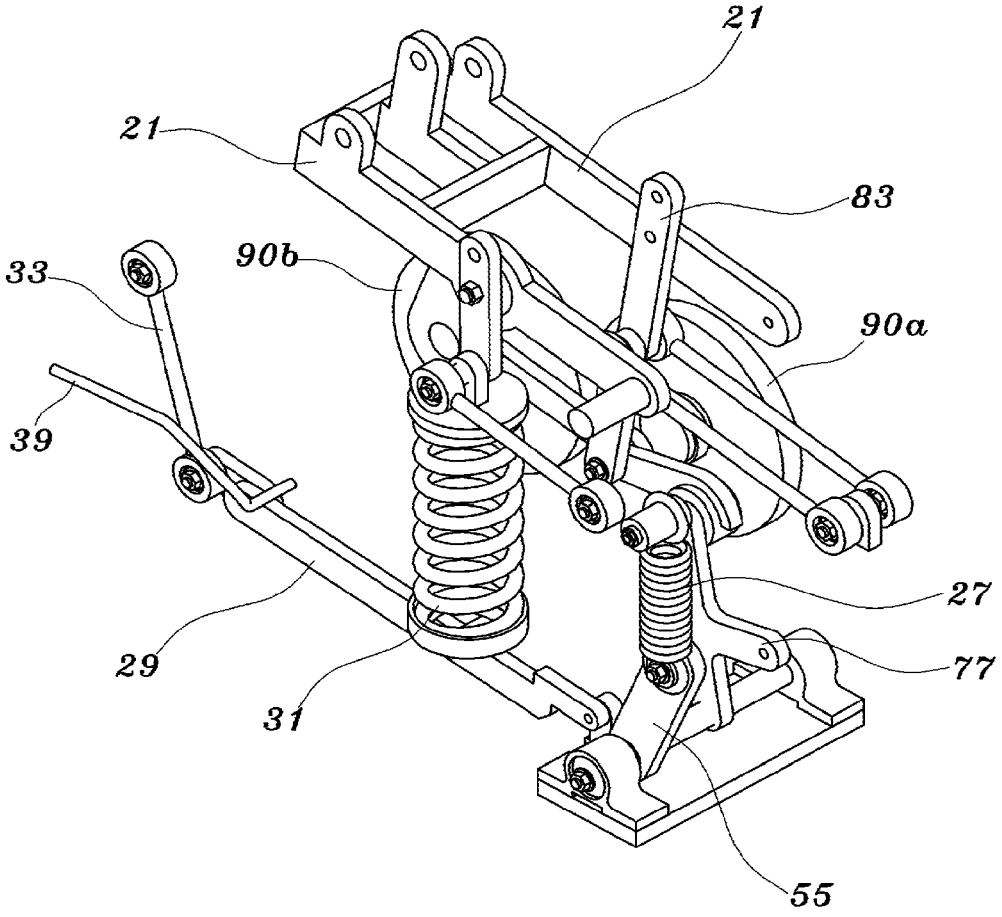
FIGS. 6 and 7 are views for explaining a main spring and a coil spring.

In addition, an operation frame 21 is rotatably installed at a center part of the horse riding exercise machine and has one end rotatably coupled to the shaft 19 (Refer to FIG. 6).

Figure 5:
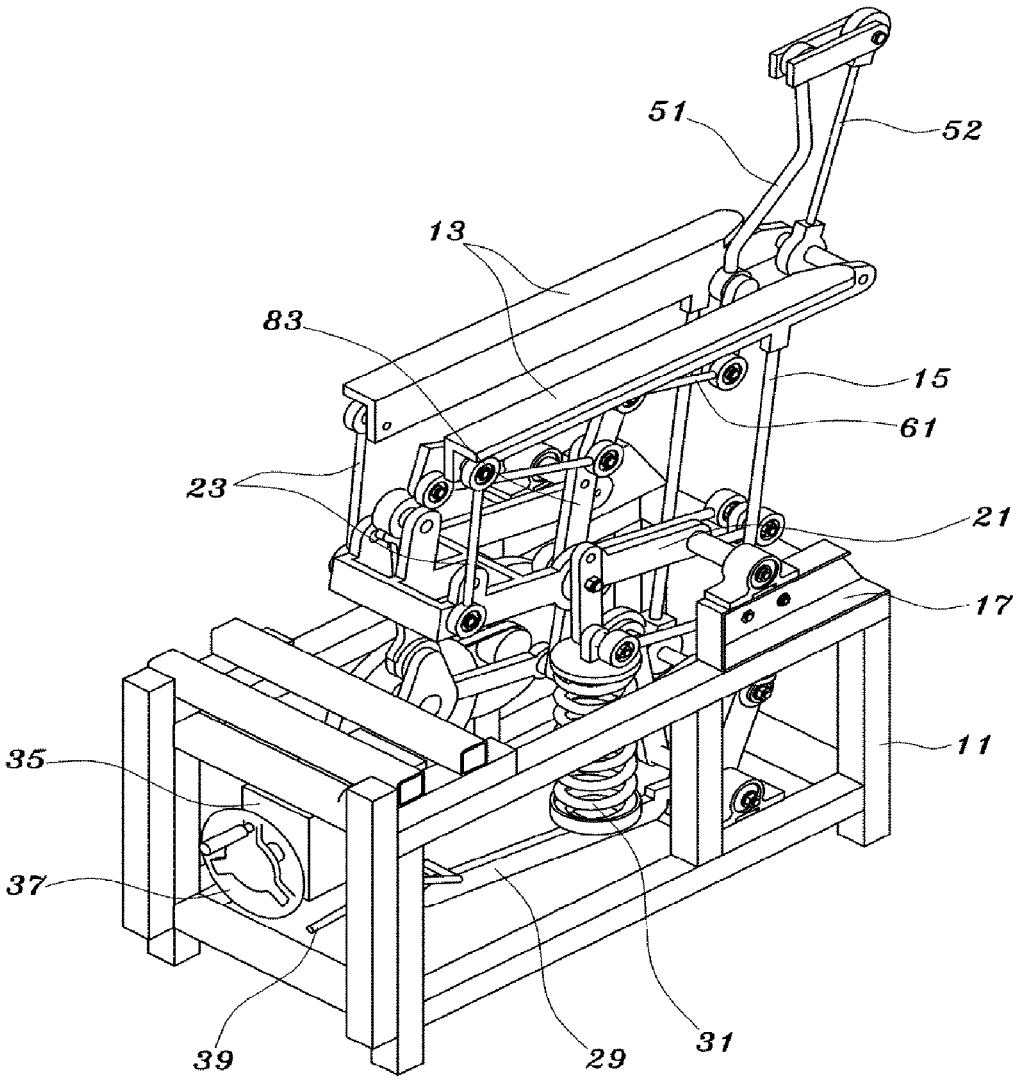

Further, a pair of operation rods 23 having end parts rotatably coupled to an end part of the operation frame 21 and opposite end parts rotatably installed to both side surface parts at a rear part of the saddle support 13 are installed (Refer to FIGS. 3 and 5).

Figure 7:
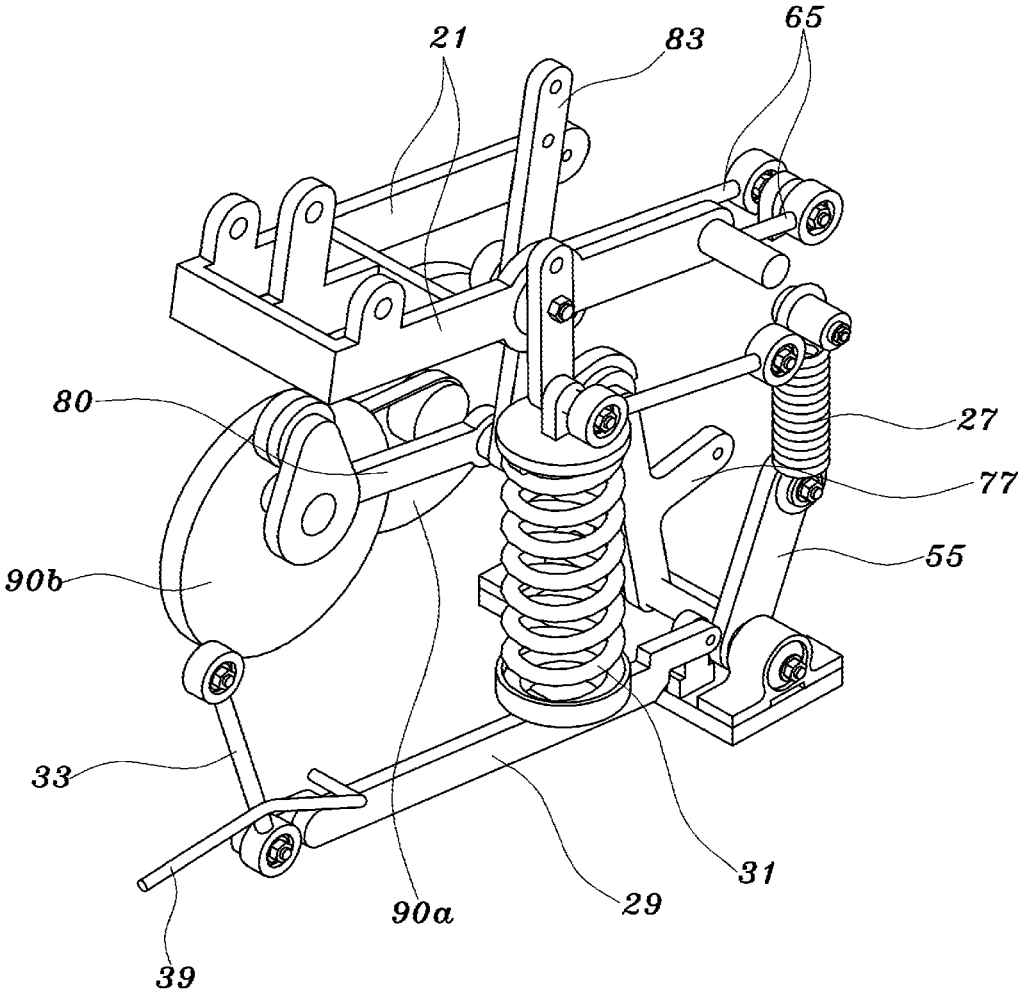
Figure 8:
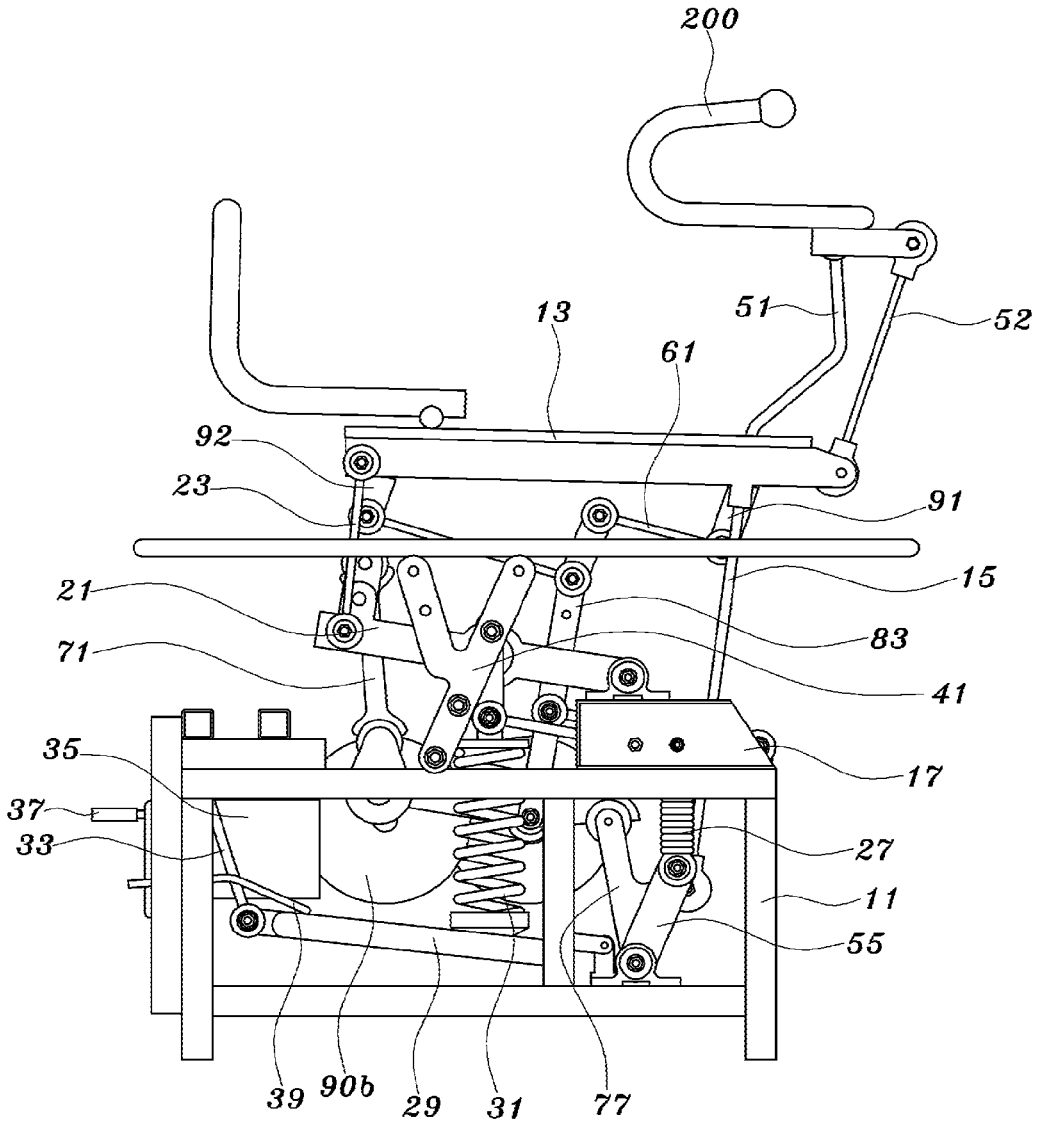
FIG. 8 is a side view of the horse riding exercise machine.

A lower support bracket 25 is installed at a lower part of the body frame 11, and as shown in FIGS. 6 and 7, a coupling bar 55 is rotatably installed on the lower support bracket 25, and a coil spring 27 is coupled and seated to the coupling bar 55.

Figure 9:
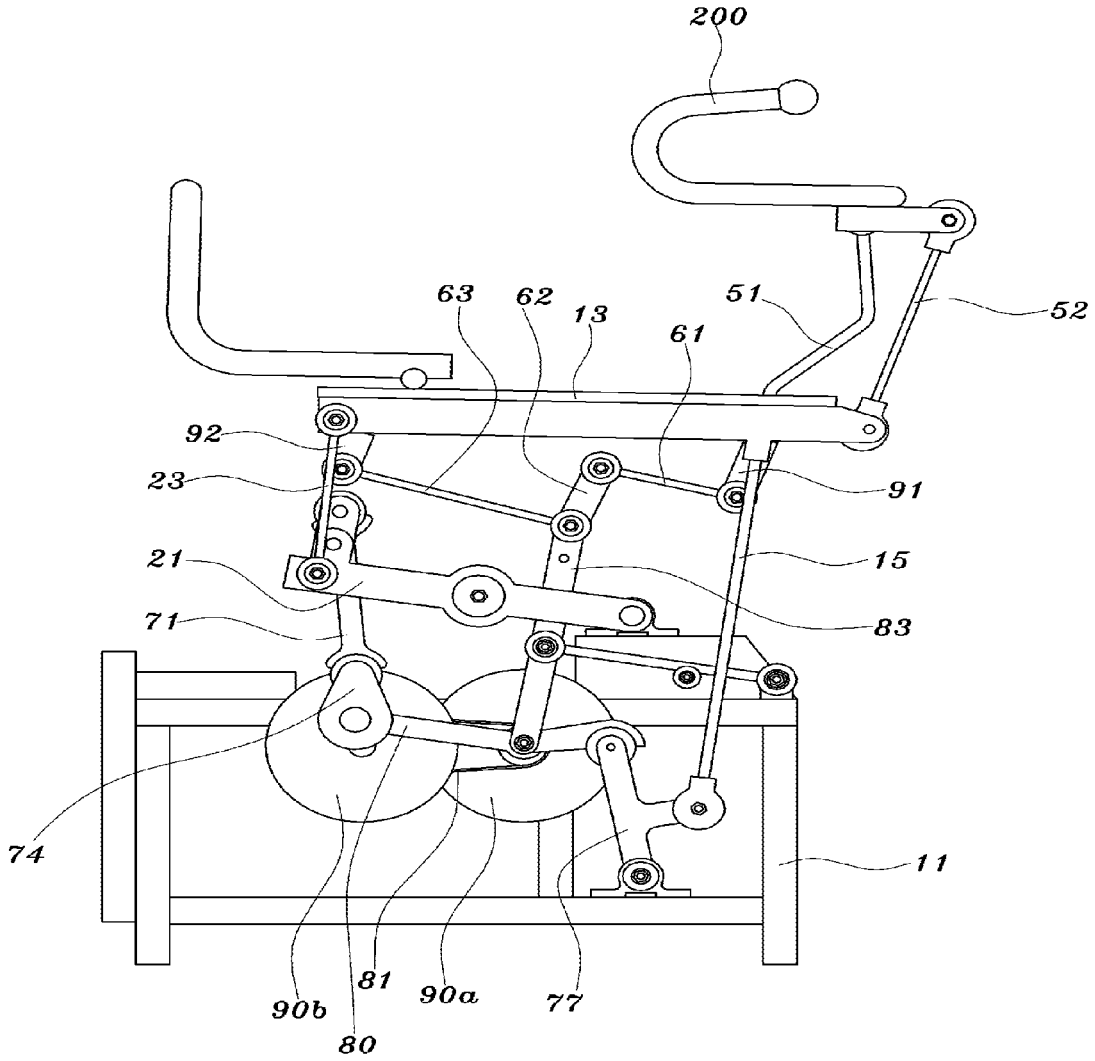
FIGS. 9 and 10 are side views of the main parts.

In addition, a T bar 77 formed in a "T" shape is installed at the lower support bracket 25, and as shown in FIG. 9, an elevation rod 15 is coupled to the T bar 77.

The T bar 77 interworks with the coupling bar 55 such that, when the T bar 77 rotates on the lower support bracket 25, the coupling bar 55 interworks with the T bar and rotates. Therefore, the elastic force of the coil spring 27 influences the T bar 77 and the elevation rod 15 via the coupling bar 55. One end of an elevating rod 15 is coupled to the T bar 77 and an opposite end is coupled to the saddle support 13 (Refer to FIG. 5).

As shown in FIGS. 2 and 3, a forward-backward rod 51 is rotatably installed on the saddle support 13 and has one end installed to a lower part of a handle 200. A link rod 52 having one end rotatably installed at a lower part of the handle 200 and an opposite end rotatably installed at the saddle support 13 is installed.

Figure 10:
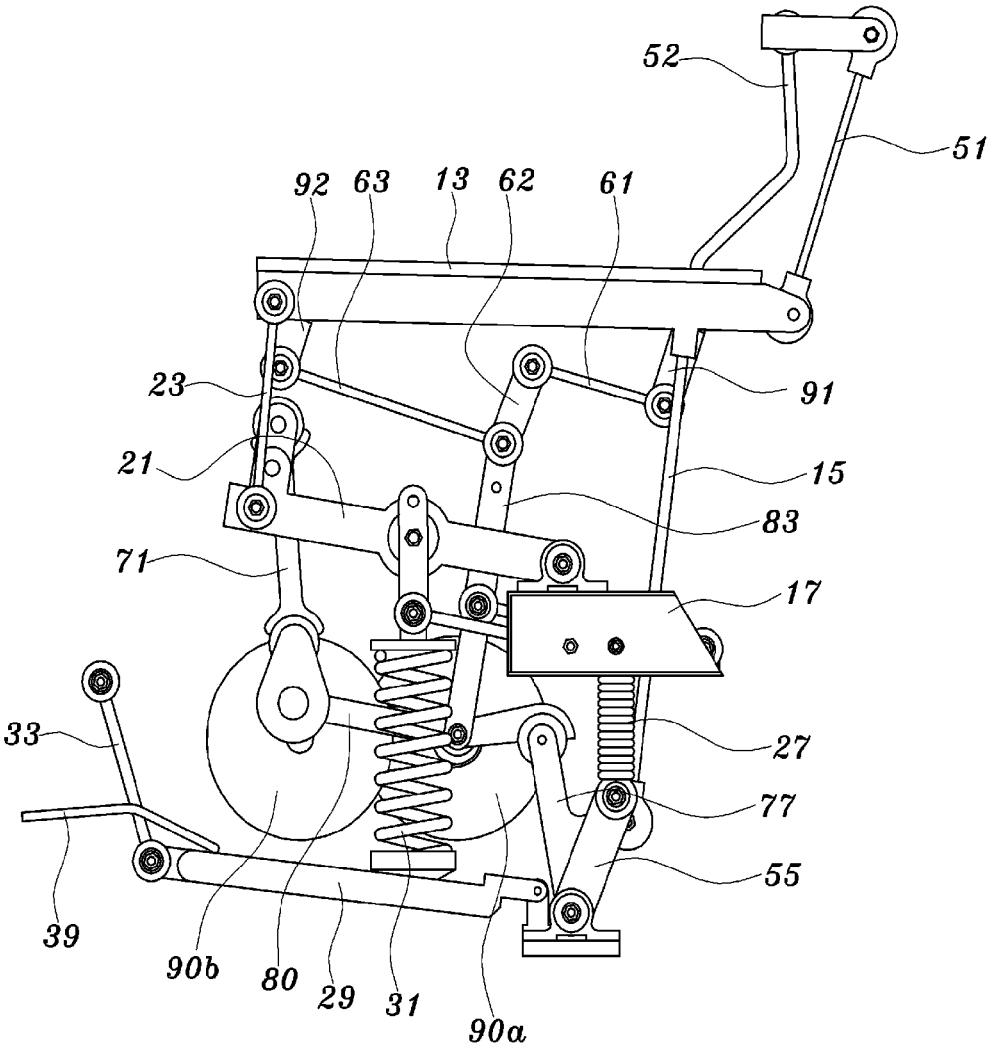

As shown in FIGS. 9 and 10, a first bar 91 is coupled to the forward-backward rod 51 to interwork with the forward-backward rod 51 and has one end rotatably installed at a front part of the saddle support 13, and a second bar 92 has one end rotatably installed at a rear of the saddle support 13.

In addition, a first rod 61 has one end rotatably coupled to a lower end part of the first bar 91, a second rod 62 is rotatably coupled to the first rod 61, and a third rod 63 is rotatably coupled to the second rod 62. Further, a vertical bar 83 rotatably is coupled to a part to which the second rod 62 and the third rod 63 are coupled. In addition, a lower bar 80 is rotatably installed at a lower end part of the vertical bar 83 (Refer to FIGS. 9 and 10).

As shown in FIGS. 3 and 9, a movable bar 71 is rotatably coupled at a rear end of the operation frame 21, a second flywheel **90*b* is coupled to a lower end part of the movable bar 71 by a link 74 such that the second flywheel 90*b* is rotated by an elevation of the movable bar 71, and a first flywheel 90*a* is interlocked to the second flywheel (90*b*) by a belt 81**.

In addition, a rotation frame 29 is shown in FIG. 10. One end of the rotation frame 29 is rotatably installed at the lower support bracket (25) and an opposite end is formed in a form of a free end.

As shown in FIG. 7, a main spring 31 is seated on a top surface of the rotation frame 29. The main spring 31 supports the operation frame 21.

Figure 4:
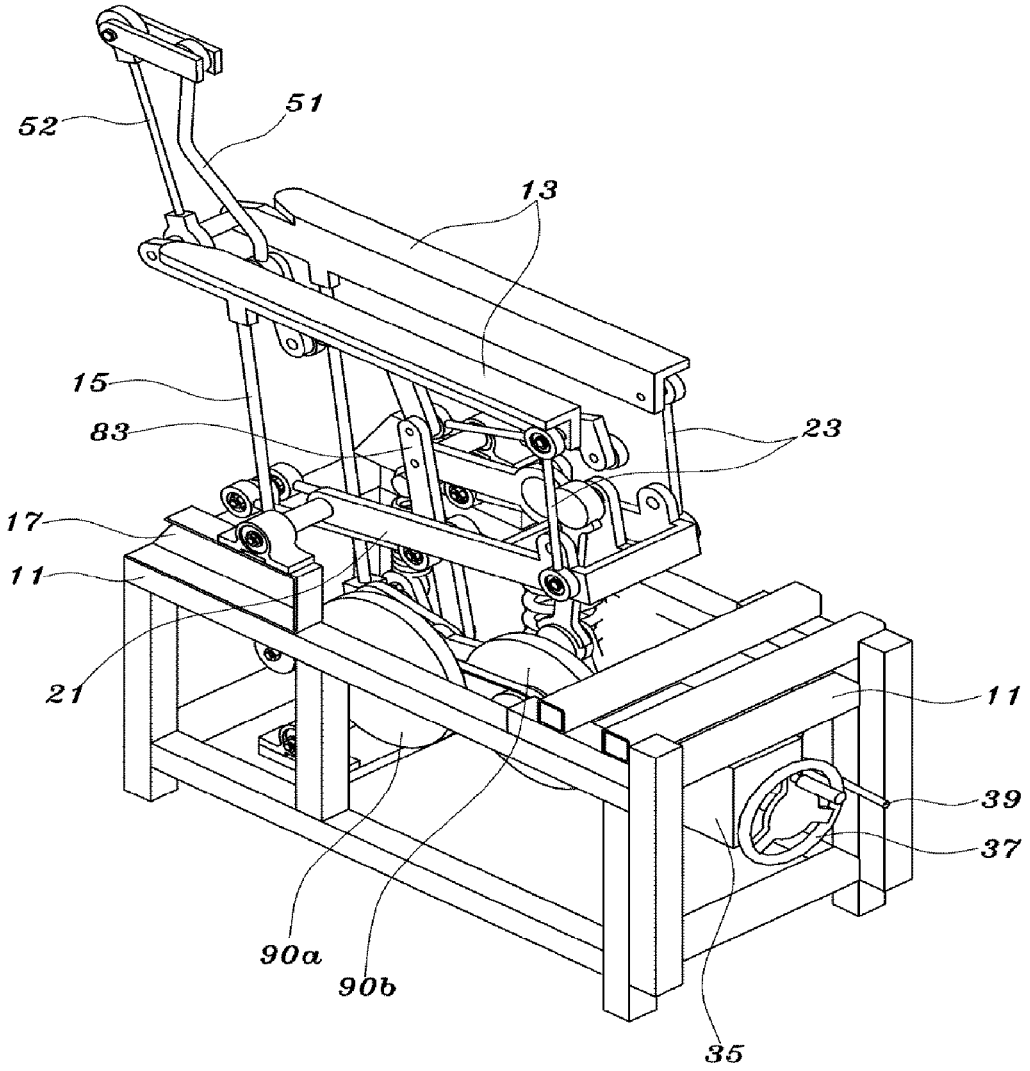
FIGS. 4 and 5 are rear perspective views showing the main parts of FIG. 3.

A gear box 35 and a handle 37 is shown in FIGS. 4 and 5. The gear box 35 is installed at a rear part of an inner space of the body frame 11, and a worm (not shown) and a worm gear (not shown) are provided in the gear box 35. The worm and the worm gear decrease the torque, however the embodiment is not limited thereto and other mechanical elements may be used. In addition, a handle 37 is installed outside the body frame 11 to rotate the worm of the gear box 35.

Figure 12:
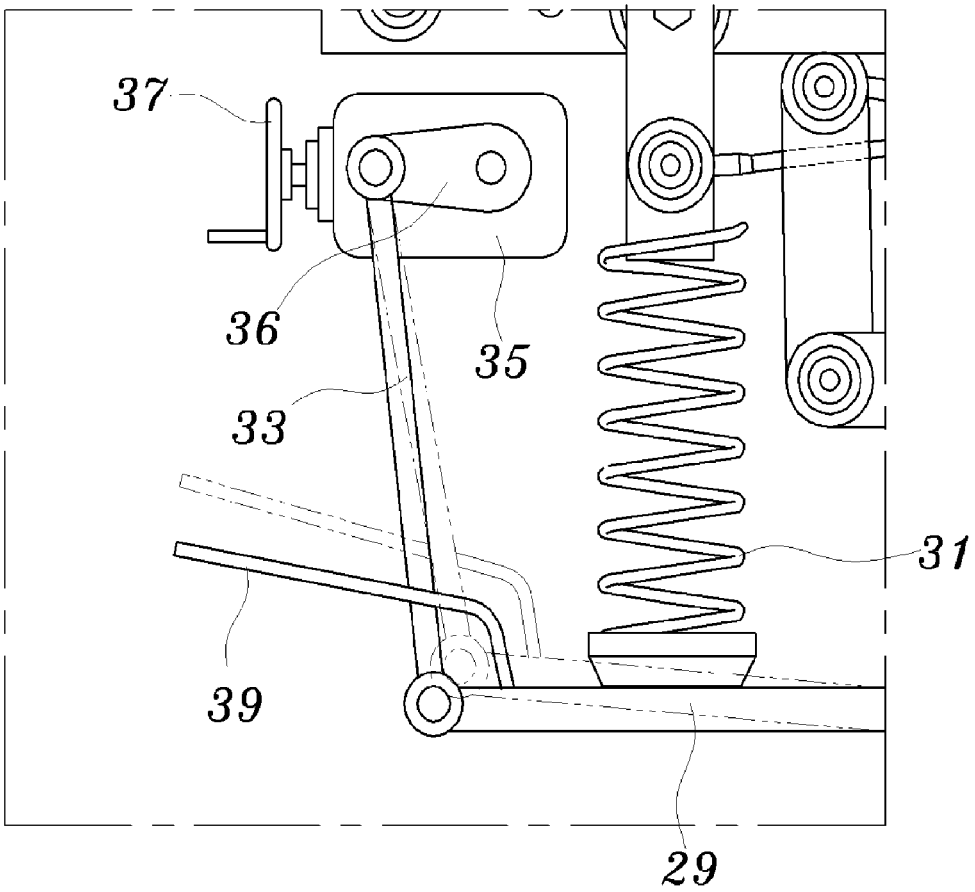
FIG. 12 is a view for explaining an adjustment according to weight.

In addition, as shown in FIG. 12, a crank 36 is coupled to the worm gear in the gear box 35, and the crank interworks with the rotation frame 29 by the rotation rod 33. Therefore, the user operates the handle 37 to elevate a lower end part of the main spring 31. As shown in FIGS. 1 and 3, the handle 37 is installed outside of the body frame 11 so that the user may easily operate the handle 37.

In addition, an indication bar 39 having one end fixed to the rotation frame 29 and an opposite end protruding out of the body frame 11 is installed such that the opposite end protrudes out of the body frame 11 elevates according to an elevation of the rotation frame 29.

Figure 11:
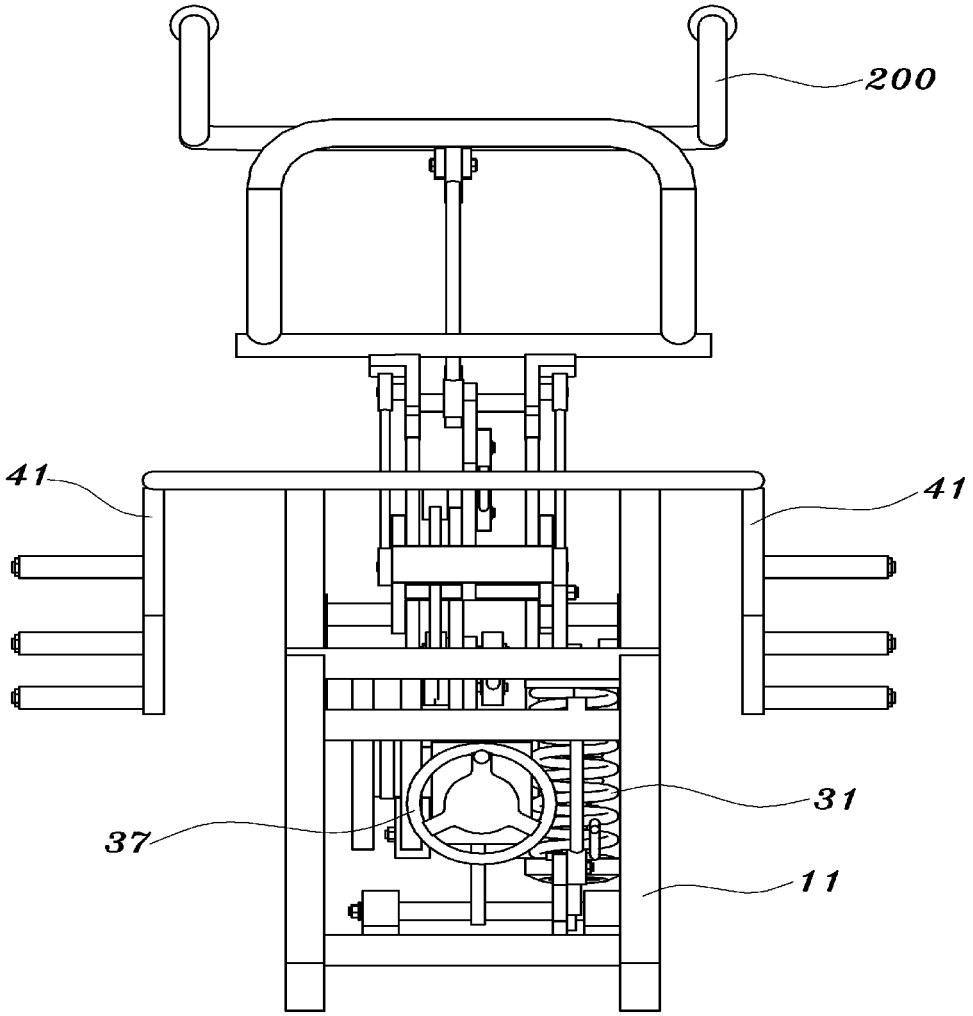
FIG. 11 is a rear view of the main parts.

As shown in FIGS. 1 and 11, a foot support 41 is installed on a frame of a cover formed at both side surfaces of the saddle 100, the foot support 41 includes an inclined frame 43 inclined downward and a plurality of support bars 45 spaced apart from the inclined frame 43 by a predetermined distance, and the support bars 45 located at upper positions may be folded by a hinge.

An operation according to the configuration described above will be described below.

In addition, as shown in FIGS. 1 and 2, the handle 200 allows the body to maintain balance and prevent the body from falling during horse riding and the handle may be pulled and pushed back and forth, respectively, by hand. The handle 200 is in a shape of "U" laid down sideways so that the handle may be gripped by both hands.

When the user pushes the handle to a forward direction by using the center of the body while gripping the handle 200, the upper end of the forward-backward rod 51 leans forward and is pushed, and the lower end of the forward-backward rod 51 is pushed to a backward direction. One end of the link rod 52 installed adjacent to the forward-backward rod 51 is rotatably installed at the handle 200 and the other end is rotatably installed at the saddle support 13. Therefore, when the forward-backward rod 51 moves, the link rod 52 also moves, thus the handle 200 moves horizontally.

According to the movement, the first bar 91 and the first rod 61, the second rod 62, and the second rod 62 and the third rod 63 move by a joint, and the vertical bar 83 rotates around a center by the movement. The lower bar 80 rotates by a rotation of the vertical bar 83 (Refer to FIG. 10).

In addition, when the user pushes the handle forward, the upper end part of the forward-backward rod 51 moves forward, and the lower end of the first bar 91 interworking with the front/rear rod 51 moves backward. When the lower end of the first bar 91 moves backward, the lower part bar 80 moves forward by the vertical bar 83.

In addition, when the saddle support 13 is elevated by using the weight of the user while the user is seated on the horse saddle 100, the operation frame 21 rotates around the center by the operation rod 23. The elevation rotates the second flywheel **90*b* coupled to the movable bar 71 by the crank. When the user moves the center of gravity back and forth while gripping the handle 200, the second flywheel 90*b* rotates 360° or more. The torque continues to rotate by inertia, and even when the user is sitting still on the horse saddle 100, the second flywheel 90*b* rotates and elevates the horse saddle 100**.

In addition, the adjustment according to the weight of the user will be described.

Figure 13:
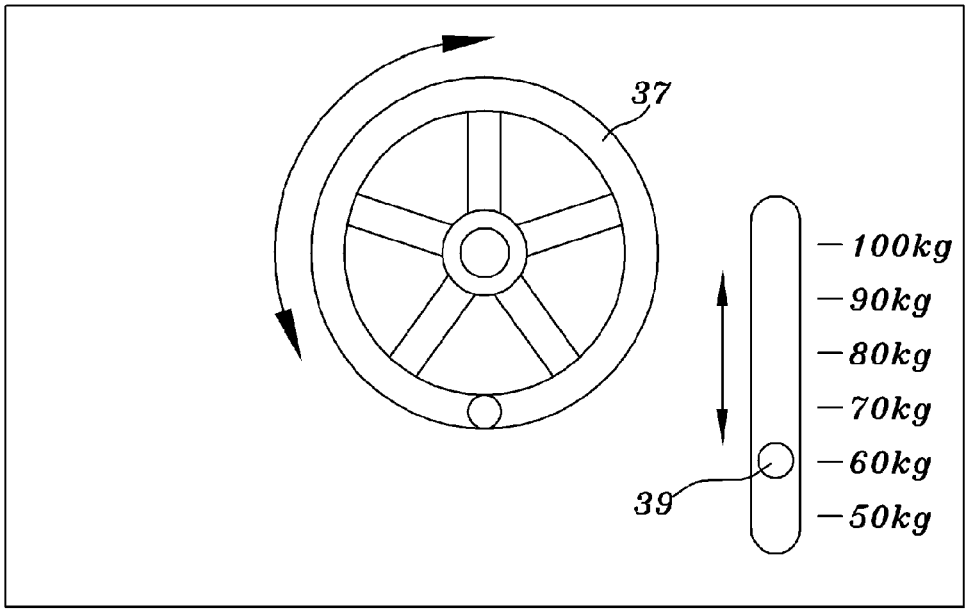
FIG. 13 is a view for explaining a handle and an indication bar.

As shown in FIGS. 4 and 5, the handle 37 is installed at a back surface of the body frame 11. In addition, as shown in FIG. 13, a long hole is formed next to the handle 37 and an indication bar 39 protrudes through the long hole, and markings are formed according to weight along the long hole.

Therefore, when the user rotates the handle 37, the rotation rod 33 coupled to the gear box 35 and the rotation frame 29 interworking with the rotation rod 33 are elevated, and the main spring 31 is elevated by the elevating rotation frame 29. As shown in FIG. 13, the indication bar 39 also elevates along the markings by the elevating rotation frame 29.

In other words, when the user rotates the handle 37 and positions the indication bar 39 to a position indicating the weight of the user, the main spring 31 also elevates to apply an elastic force at an appropriate position.

Figure 14:
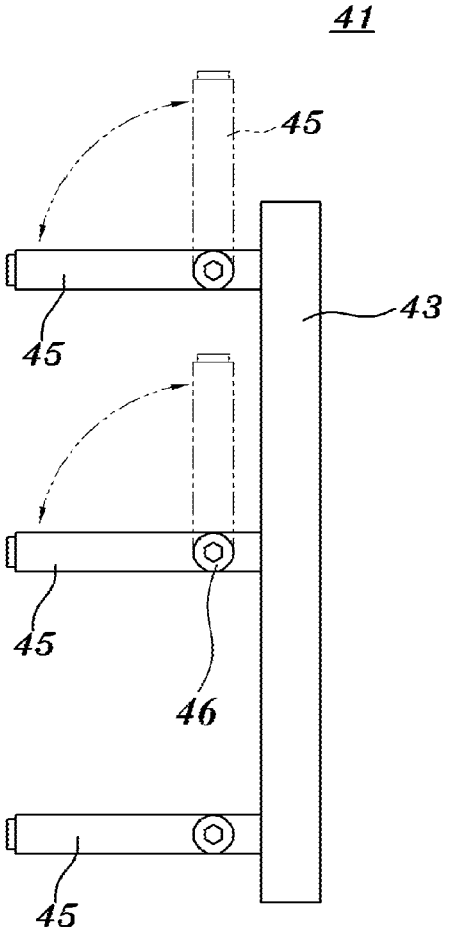
FIG. 14 is a view for explaining a foot support.

In addition, as shown in FIGS. 1 and 14, the foot support 41 includes the inclined frame 43 inclined to a lower part thereof and a plurality of support bars 45 spaced apart from the inclined frame 43 at a predetermined distance, and as shown in FIG. 14, at least one of the support bars 45 may be folded by a hinge 46.

Therefore, the user may easily get on or get off the saddle 100 by using one of the support bars 45 according to the height of the user.

According to the horse riding exercise machine of the present invention, when the user elevates the saddle support 13 by using the weight of the of the user while sitting on the horse saddle 100, the operation frame 21 also rotates around a center by the operation rod 23 such that the second flywheel **90*b* coupled to the movable bar 71** by a crank is rotated by the elevation.

When the user does not use the weight while sitting on the horse saddle 100, the second flywheel **90*b*** is automatically rotated so that the horse riding exercise is possible.

The second flywheel **90*b* may be automatically rotated by automatically rotating the first flywheel 90*a* interworking with the second flywheel 90*b* by the belt 81**.

Figure 15:
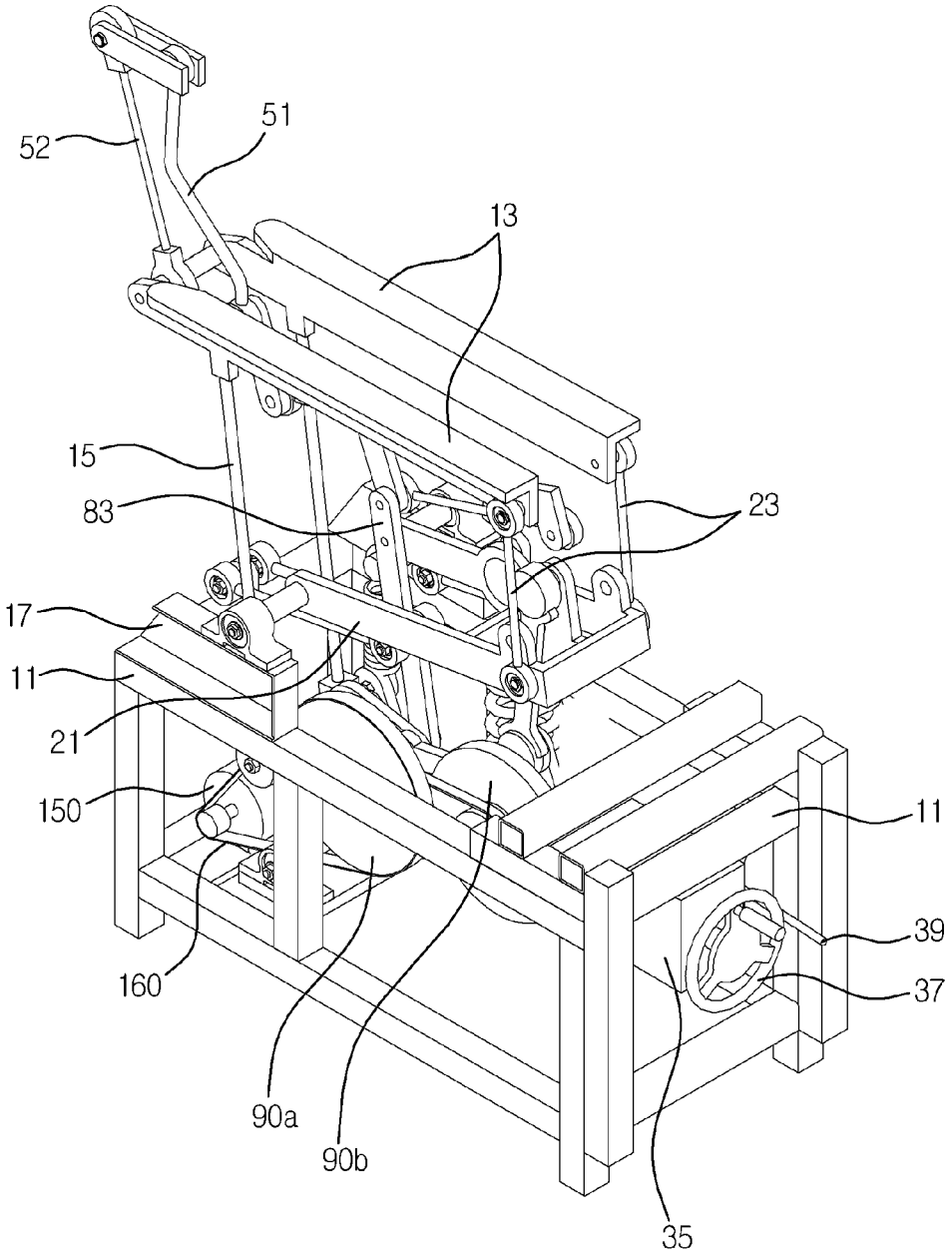
FIGS. 15 and 16 are views showing the horse riding exercise machine according to another embodiment.
Figure 16:
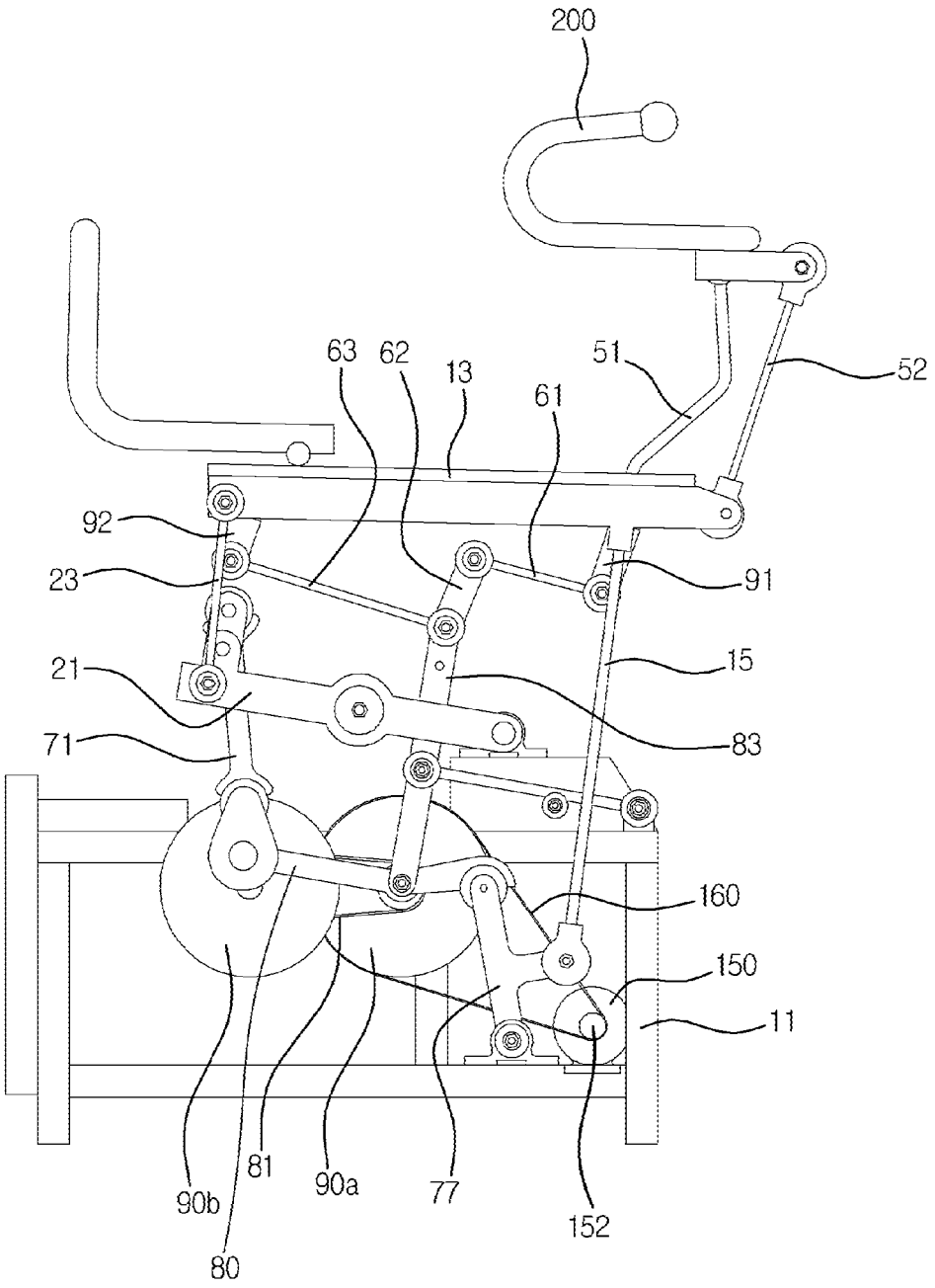

In this case, as shown in FIGS. 15 and 16, to automatically rotate the first flywheel **90*a*, a motor 150 is fixed to a lower part of the body frame 11 and an electrical driving belt 160 is coupled to a shaft 152 of the motor 150 and coupled to the first flywheel 90*a* to rotate the first flywheel 90*a***.

According to the present invention, when the user does not use the weight while sitting on the horse saddle 100, the first flywheel **90*a* is rotated by the motor 150 and the electrical driving belt 160 to rotate the second flywheel 90*b* interworking with the first flywheel 90*a* so that the horse saddle 100** is elevated.

The user may automatically exercise by horse riding through operating the motor 150, and the motor 150 may be stopped to manually exercise by horse riding when exercising by horse riding through using the weight of the user.

While the horse riding exercise machine according to the present invention has been particularly shown and described by embodiments, it should not be interpreted in any way to limit the scope of the present invention. Therefore, the scope of the present invention is not limited to the described embodiments, but is limited only by the accompanying claims and equivalents thereof, and any alterations equivalent to the accompanying claims are within the scope of the present invention.

What is claimed is:

1. A horse riding exercise machine comprising:

a body frame having a box shape;

a saddle support spaced apart from a central upper part of the body frame in an upward direction by a predetermined distance to support a saddle;

a pair of upper support brackets mounted on a top surface of the body frame while facing each other;

a shaft coupled to one support bracket of the pair of upper support brackets;

an operation frame having one end rotatably coupled to the shaft;

a pair of operation rods having end parts rotatably coupled to an end part of the operation frame and opposite end parts rotatably installed to both side surface parts of a rear part of the saddle support;

a lower support bracket installed at a lower part of the body frame;

a coupling bar rotatably coupled to the lower support bracket;

a coil spring having one end coupled to the coupling bar;

a T bar formed in a "T" shape and having one end coupled to the lower support bracket;

an elevation rod having one end coupled to the T bar and an opposite end coupled to the saddle support;

a forward-backward rod rotatably installed on the saddle support and having one end installed to a lower part of a handle;

a link rod having one end rotatably installed at a lower part of the handle and an opposite end rotatably installed at the saddle support;

a first bar coupled to the forward-backward rod to interwork with the forward-backward rod and having one end rotatably installed at a front part of the saddle support;

a second bar having one end rotatably installed at the rear part of the saddle support;

a first rod having one end rotatably coupled to a lower end part of the first bar;

a second rod rotatably coupled to the first rod;

a third rod rotatably coupled to the second rod;

a vertical bar having an upper end part rotatably coupled to a part at which the second rod and the third rod are coupled;

a movable bar rotatably coupled at a rear end of the operation frame;

a second flywheel coupled to a lower end part of the movable bar by a link to rotate through an elevation of the movable bar;

a first flywheel interworking with the second flywheel by a belt;

a lower bar rotatably installed at a lower end part of the vertical bar;

a rotation frame having one end rotatably installed at the lower support bracket and an opposite end in a form of a free end;

a main spring having one end fixed to the operation frame and an opposite end seated on a top surface of the rotation frame;

a gear box installed in an inner space of the body frame;

a second handle installed outside the body frame; and a rotation rod having one end coupled to the gear box and an opposite end installed to the rotation frame to rotate by an operation of the second handle.

2. The horse riding exercise machine of claim 1, further comprising an indication bar having one end fixed to the rotation frame and an opposite end protruding out of the body frame such that the opposite end protruding out of the body frame elevates according to an elevation of the rotation frame.

3. The horse riding exercise machine of claim 2, further comprising a foot support at both side surfaces of the saddle.

4. The horse riding exercise machine of claim 3, wherein the foot support comprises an inclined frame inclined downward; and a plurality of support bars spaced apart from the inclined frame by a predetermined distance.

5. The horse riding exercise machine of claim 4, wherein at least one of the support bars is foldable by a hinge.

6. The horse riding exercise machine of claim 1, wherein the coupling bar interworks with the T bar.

7. The horse riding exercise machine of claim 1, further comprising a motor installed at a lower part of the body frame; and an electrical driving belt coupled to a shaft of the motor and the first flywheel to rotate the first flywheel.

* * * * *